US006684410B2

(12) United States Patent
Robinett et al.

(10) Patent No.: US 6,684,410 B2
(45) Date of Patent: Feb. 3, 2004

(54) ATHLETIC SHORTS

(75) Inventors: Christopher Todd Robinett, Oklahoma City, OK (US); Kim A. Robinett, Oklahoma City, OK (US)

(73) Assignees: Christopher Robinett, Oklahoma City, OK (US); Kimberly Robinett, Oklahoma City, OK (US)

( * ) Notice: Subject to any disclaimer, the term of this patent is extended or adjusted under 35 U.S.C. 154(b) by 0 days.

(21) Appl. No.: 10/121,005

(22) Filed: Apr. 12, 2002

(65) Prior Publication Data

US 2003/0192106 A1 Oct. 16, 2003

(51) Int. Cl.[7] ..... A41D 13/00
(52) U.S. Cl. ..... 2/228; 2/238; 2/69
(58) Field of Search ..... 2/228, 238, 227, 2/79, 69, 70, 80, 83; 450/94, 95, 97, 100, 101, 104, 106, 131, 107; 482/74, 120–122, 124, 105, 131

(56) References Cited

U.S. PATENT DOCUMENTS 4,252,112 A 2/1981 Joyce
4,910,802 A * 3/1990 Malloy ..... 2/227
4,953,856 A 9/1990 Fox, III
5,033,117 A 7/1991 Fairweather
5,046,194 A * 9/1991 Alaniz et al. ..... 2/69
5,109,546 A * 5/1992 Dicker ..... 2/69
5,201,074 A * 4/1993 Dicker ..... 2/69
5,256,119 A 10/1993 Tudor
5,267,928 A * 12/1993 Barile et al. ..... 482/124
5,465,428 A * 11/1995 Earl ..... 2/238
5,598,586 A 2/1997 Munjone
5,727,254 A 3/1998 Dicker
6,047,405 A * 4/2000 Wilkinson ..... 2/69
6,047,406 A * 4/2000 Dicker et al. ..... 2/69
6,161,222 A 12/2000 Strickland et al.
6,195,801 B1 * 3/2001 Meyers ..... 2/69 X
6,231,488 B1 * 5/2001 Dicker et al. ..... 482/124
6,243,880 B1 6/2001 Lyden

* cited by examiner

*Primary Examiner*—Gloria M. Hale

(57) ABSTRACT

Athletic Shorts are a tight fitted running shorts that improve the performance of running or walking by utilizing gravity as a source of energy. The shorts have elastic straps attached from the waist and extend across the front side of the leg to the bottom near the leg opening of the shorts. When standing straight up the elastic is elongated by the weight of the leg. The elongated elastic provides a pulling energy for the leg by contracting when moving up in a step of a walk or stride of a run. When the step or stride is lowered back to the ground the elastic is again elongated by the weight of the leg. The repeated action of the contraction and elongation of the elastic straps provide increased performance when walking or running. Leg Adjustment Straps around the bottom of the shorts are used to draw the shorts tight to the leg. Athletic Shorts increase performance when gauging time over a fixed distance utilizing gravity of the leg as a source of energy in the physical walking or running action.

2 Claims, 8 Drawing Sheets

ATHLETIC SHORTS

BACKGROUND OF THE INVENTION

1. Field of the Invention

This invention relates to physical activity in the form of walking or running which reduces the physical stress of raising the legs and maintaining proper posture.

2. Prior Art

Raising the legs during exercising in the form of running or walking over an extended period of time will cause fatigue. During sustained or long distance or long duration of physical activity the physical fatigue becomes excessive to the point that the legs feel very heavy. This excessive fatigue will slow a person's physical motion of the legs. This slow down creates slower running or walking. As the fatigue continues to slow down the body the need for more energy during the end of physical exercise increases to maintain a higher performance.

During excessive workouts involving running, walking, or physical activity, poor posture occurs due to stress and decrease of energy. Poor posture refers to not maintaining a back-straight and head-up position. Poor posture refers to bending or leaning over at the waist and lowering of the head during excessive physical activity. The result of poor posture is a decrease of performance due to an increase of stress on the back and the neck.

Examples of prior art found for running shorts are listed below. The prior art does not solve the problem of the legs being heavy causing the runner or walker to slow down. The prior art does not address the problem of poor posture during exercise.

U.S. Pat. No. 6,161,222 Strickland et.al. is an Athletic Garment with Inner Thigh Guards. This prior art does not help with raising the legs or posture.

U.S. Pat. No. 6,243,880 Lyden is Athletic Shorts. These shorts are very basic to a runner for unrestricted breathing and extension of the legs. These shorts do not help the runner lift the legs in any way or help with poor posture.

U.S. Pat. No. 5,598,586 Munjone is Athletic Shorts with inner and outer layers. These shorts have an inner and outer layer for protection. These shorts do not help the runner lift the legs or maintain proper posture.

U.S. Pat. No. 5,033,117 Fairweather is Exercise Garment. This exercise garment has pockets used for a weight, which would provide resistance to raising the leg. This is the opposite of helping to raise the legs. This device would not help a runner to maintain proper posture.

U.S. Pat. No. 4,953,856 Fox, III is Exercise Garment. This garment has placement of weights to provide resistance during exercise. This is the opposite of helping to raise the legs during running or walking. This device does not help to maintain proper posture.

U.S. Pat. No. 5,727,254 Dicker is Resistive Exercise Pants and Hand Stirrups. This garment uses bands to resist movement. This is the opposite of helping to raise the legs. These bands do not help to raise the leg during running and does not provide help with maintaining proper posture.

U.S. Pat. No. 4,252,112 Joyce is Strap Device for Assisting in Hip, Knee and Foot Movement. This would be the same concept except that the lower half of the device is not needed for a runner who is not paralyzed. This device does not help maintain proper posture.

U.S. Pat. No. 5,256,119 Tudor is Leg Extension Exercise Device. This device is worn on the back of the leg to keep from hyper-extending the leg at the knee. This device has a different purpose and, therefore, would not aid in raising the leg.

None of the prior art examples support helping with extensive physical activity. The prior art examples found tend to do the opposite. U.S. Pat. No. 5,727.254, 4,953,856 and 5,033,117 all use weights or bands to provide resistance to raising the legs. The patents used for athletic shorts do nothing to provide help in lifting the leg for running. Therefore, we found no prior art for this device to help lift the leg and provide help with maintaining proper posture.

SUMMARY OF THE INVENTION

It is therefore, the object of this invention to provide athletic shorts that will increase physical performance over extensive workout time periods.

Athletic Shorts according to this invention will help support raising the legs and maintaining a persons posture throughout the workout period. This support will improve the performance when gauging time over a fixed distance. This performance will decrease time over distance by allowing the person to maintain a constant leg speed of movement.

To improve the performance by maintaining a sustained leg stride, support needs to be given to help raise the legs. This support of raising the legs being one of the objects of this invention is through the use of elastic straps.

Two independent elastic straps starting at the middle of the back extend in opposite directions around the waist secured through belt loops. The elastic strap proceeds downward at the front and middle portion of the leg. As both independent straps travel down the leg to the bottom of a tight fitted running shorts they proceed around the leg above the knee. Then both independent straps returning back up the legs to the same point of where they started being the middle of the back.

The elastic strap that runs around the legs that is above the knee is fitted into a conduit that is sewn on to the lower potion of the tight fitted running shorts. The elastic strap is threaded inside the conduit as it goes around the leg above the knee holding the elastic strap in a fixed position. The elastic ends in the middle of the back are connected to a male and female parts of a buckle. The elastic straps are elongated and the buckles are adjusted such that when the buckles are snapped together a pulling force is felt at the bottom of the tight fitted running shorts above the knee. This pulling force is at the extreme when standing in an upright position. When the leg is raised this pulling force adds to the support of the effort needed to raise the leg. As the leg is lowered the process is repeated. This pulling force supporting the upward movement of the leg is one of the objects of this invention.

The next object of this invention is the support of a persons posture during excessive physical activity. The correct posture for walking or running is to maintain a straight back and a head up position. For runners, it is also recommended that the hips be projected slightly forward. The benefit of projecting the hips in a forward position is less effort to raise the leg. The elastic straps that travel around the sides and back of the waist when in an elongated position exerts a forward force of the waistline. This forward force keeps the hips projected slightly forward in the preferred position. The hips in a forward position forces straight posture of the back and head. The overall alignment of the hips, back, and head due to the force of the elongated straps keeps a runner or walker in an efficient posture, which reduces stress during extensive physical activities.

The forces on both ends of the elongated elastic straps define the two objects of this invention. One force supports the lift of the leg and the other force supports the posture of a runner or walker. The combination of these two forces benefits the runner or walker by maintaining a sustained leg stride and supporting a straight back and head posture during the physical activity. BRIEF DESCRIPTION OF THE DRAWINGS The included drawings present the advantages of the invention and illustrate embodiments with a description to explain the specification of the invention.

LIST OF REFERENCE NUMERALS

1. Frontside Belt Loop
2. Frontside Belt Loop
3. Tight Fitted Running Shorts
4. Elastic Strap
5. Conduit
6. Leg Adjustment Group
7. Male Buckle Part
8. Female Buckle Part
9. Waist Band on Tight Fitted Running Shorts
10. Backside Belt Loop
11. 7 & 8 Buckle Parts Connected
12. Group of Numbers for Lock Strap
13*a*. Elastic Harness (Engaged and Elongated) Grouping
13*b*. Elastic Harness (Disengaged and Contracted) Grouping
14. Semi-Flexible Stabilizer Grouping
15. Elastic Hook Fastener Grouping
16. Backside Belt Loop
17. Semi-Flexible Back Material Grouping
18. Elastic Harness
19. Leg Adjustment Strap
20. Leg Adjustment Pad
21. Leg Adjustment Strap Fastener
22. Elastic Hook Fastener Pad
23. Elastic Hook Fastener Ring
24. Elastic Hook Fastener
25. Semi-Flexible Stabilizer Material
26. Lock Strap Pad Strap
27. Lock Pad Material
28. Semi-Flexible Back Material
29. Elastic Harness Handle

DETAILED DESCRIPTION OF THE PREFERRED EMBODIMENTS

Detailed reference will now be made to the preferred embodiments of the invention; examples of these embodiments are illustrated in the accompanying drawings. While the invention will be described along with the preferred embodiments, it will be understood that they are not intended to restrict the invention to these embodiments. On the contrary, the invention is intended to cover equivalents, alternatives, and modification that may be incorporated within the sum and substance of the invention as defined by the appended claims.

Figure 1:
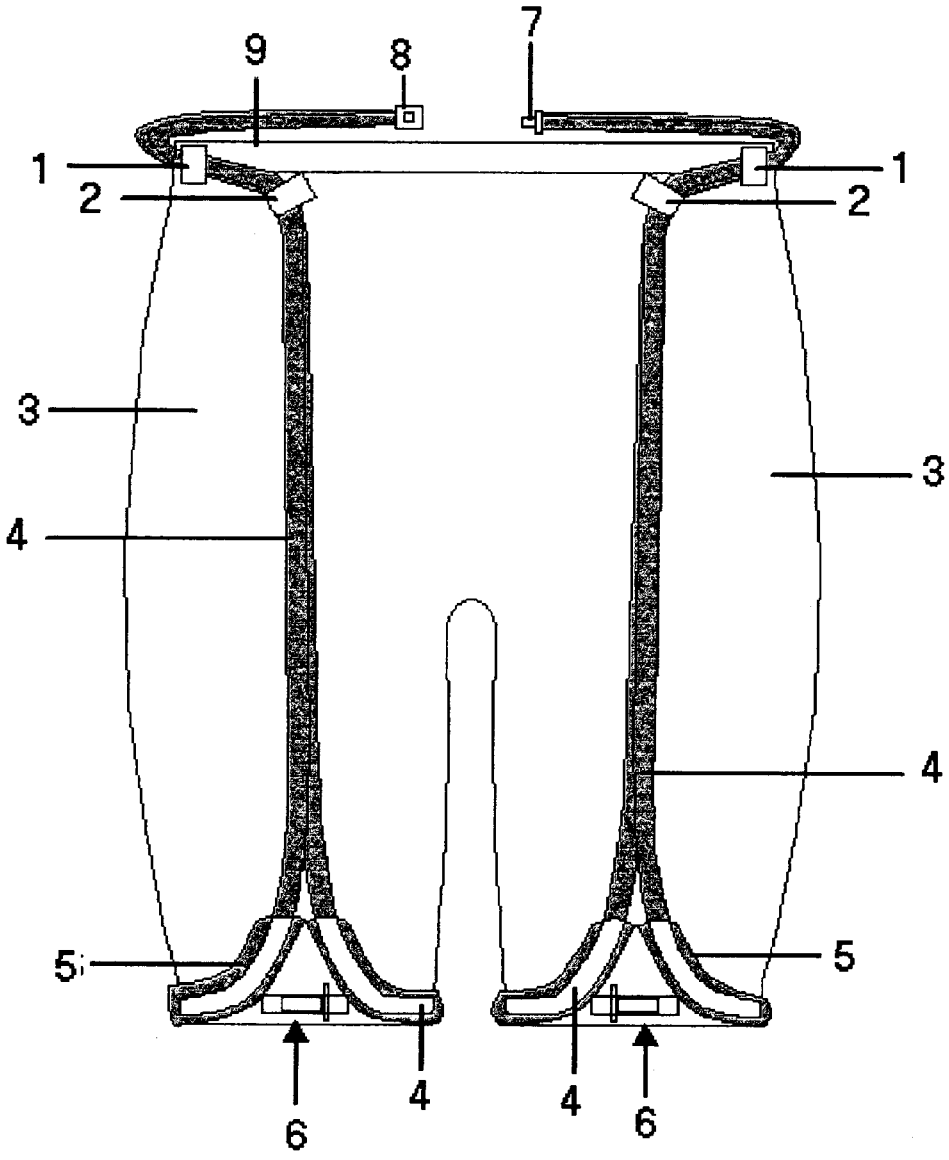
FIG. 1 is the front side of the Athletic Shorts with main embodiments.

FIG. 1 is a drawing of the front side of a tight fitted running shorts 3, which includes an elastic strap 4, wrapped around the waist through a belt loop I at the hip, which is connected to a waistband 9. The elastic strap continues through a belt loop 2 at the front of tight fitted running shorts 3. Elastic strap 4 then proceeds down the front of the leg into a conduit 5. Conduit 5 continues horizontally around the back of the leg to the other side of the front of the leg. Elastic strap 4 continues back up the front of the leg back through belt loop 2 then through belt loop 1, then through a belt loop 10 on FIG. 5 and is buckled in the back of tight fitted running shorts 3 using a male buckle part 7 on FIG. 1 and a female buckle part 8. Elastic strap 4 is elongated applying upward force to the leg. The bottom of tight fitted running shorts 3 around the leg is tightened using a leg adjustment group 6. Leg adjustment group 6 is detailed in FIG. 4. Leg adjustment group 6 is attached to the bottom around the leg of tight fitted running shorts 3. Leg adjustment group 6 consists of one strap 19, which is pulled and looped around leg adjustment strap fastener 21 and attached to leg adjustment pad 20. The bottom of tight fitted running shorts 3 around the leg will need to be tight due to the upward force from the pulling of elastic strap 4.

Figure 2:
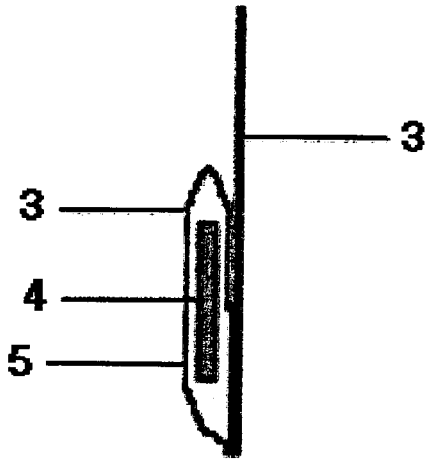
FIG. 2 is the elastic strip in a conduit sewn to a garment.
Figure 3:
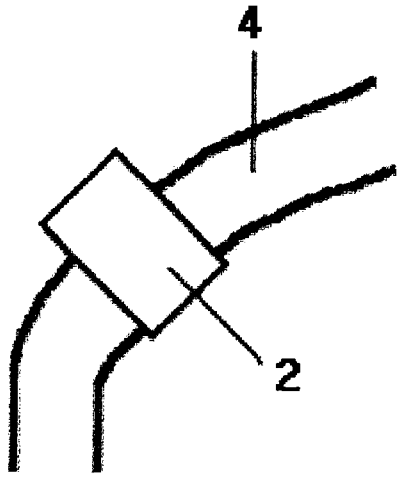
FIG. 3 is the elastic strip approaching the waist as it runs through a belt loop.
Figure 5:
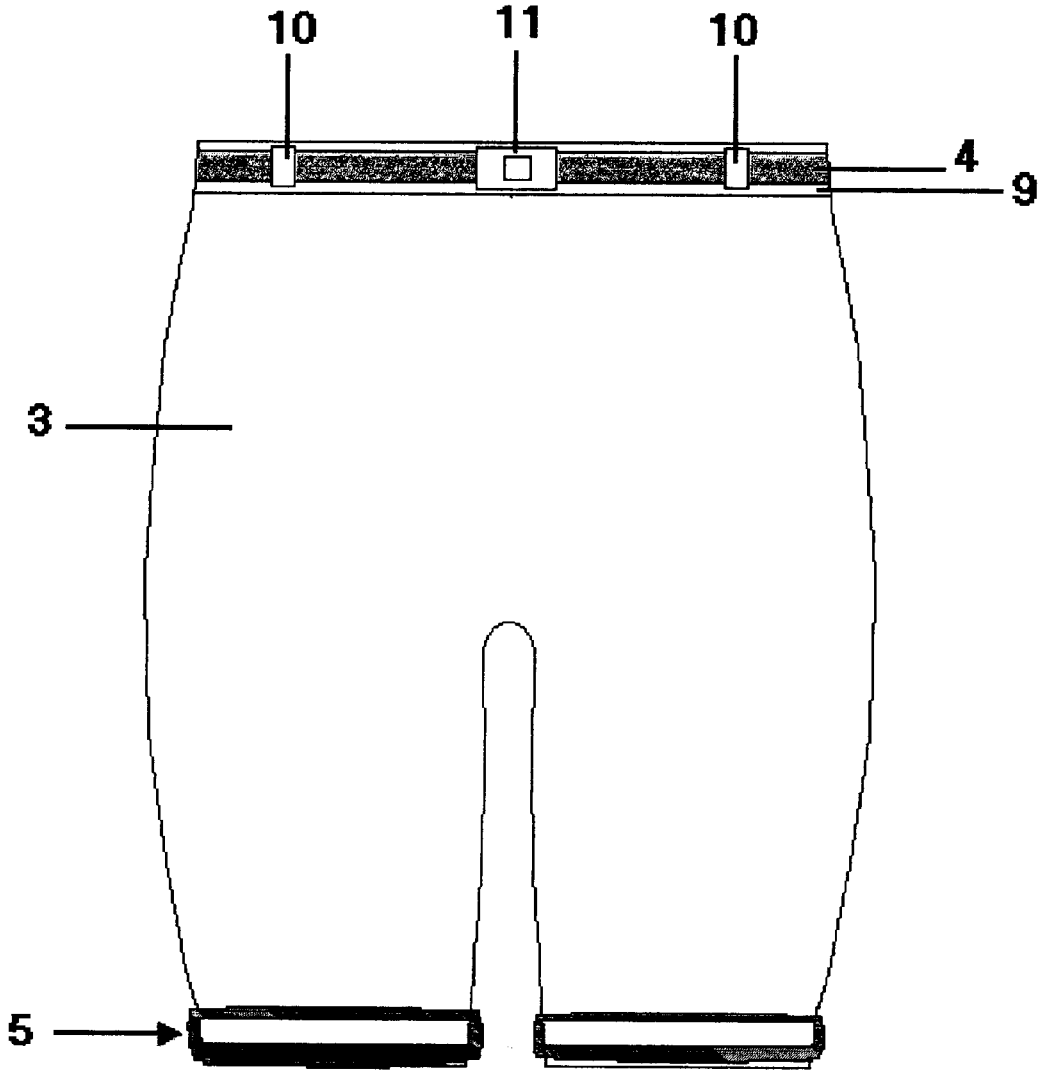
FIG. 5 is the backside of the Athletic Shorts.

FIG. 5 is a drawing of the backside of Athletic Shorts. This drawing shows elastic strap 4 entering a belt loop 10 and a buckle 11. Buckle 11 is the combination of male buckle 1 part 7 in FIG. 1 and female buckle part 8 connected together. Elastic strap 4 is shown inside conduit 5 at the bottom of the tight fitted running shorts 3 around the leg. FIG. 2 is a cross-sectional view, which shows tight fitted running shorts 3 with elastic strap 4 inside conduit 5. Elastic strap 4 inside conduit 5 is pulling up on the leg in this configuration due to the elongation of the elastic. The elongation of elastic strap 4 at waistband 9 imposes a force at the hips that rotates the pelvis forward.

The runner or walker wearing this invention feels the greatest force from elastic strap 4 when the legs are vertically straight or extended behind the upper body. This force helps to lift the leg up for the next forward leg motion in a run or walk. This supported lift reduces the stress in the legs when running or walking. The speed or distance of the physical activity can now be increased due to the support of elastic strap 4 force of this invention.

A runner or walker needs to focus on posture, which reduces the stress of the physical activity. A correct posture for a runner or walker is to maintain a straight back with the head up and to keep the hips projected slightly forward. The forward projection of the hips allows the runner or walker to raise his or her leg with greater ease. This recommended posture would reduce stress and the needed energy allowing maximum performance in the physical exercise.

The runner or walker wearing this invention will feel an apposing force from elastic strap 4 at the hips when the opposite force is created at the legs. This opposing force keeps the pelvis in a tilted forward position from elastic strap 4. The slightly forward hip position supported by this invention is the preferred posture during the physical exercise.

This invention has been built and tested to determine the actual benefits. During a trial run, a runner wearing the invention ran a 25-kilometer race approximately 6% faster than expected. The amount of energy used was reduced during the beginning and middle of the run allowing the runner to increase his pace during the end of the race. Without the use of this invention the runner normally slows down during the end of the race.

DETAILED DESCRIPTION OF THE ALTERNATIVE EMBODIMENTS

Detailed reference will now be made to the alternative embodiments of the invention; examples of these embodiments are illustrated in the accompanying drawings. While the invention will be described along with the preferred embodiments, it will be understood that they are not intended to restrict the invention to these embodiments. On the contrary, the invention is intended to cover equivalents, alternatives, and modification that may be incorporated within the sum and substance of the invention as defined by the appended claims.

Figure 6:
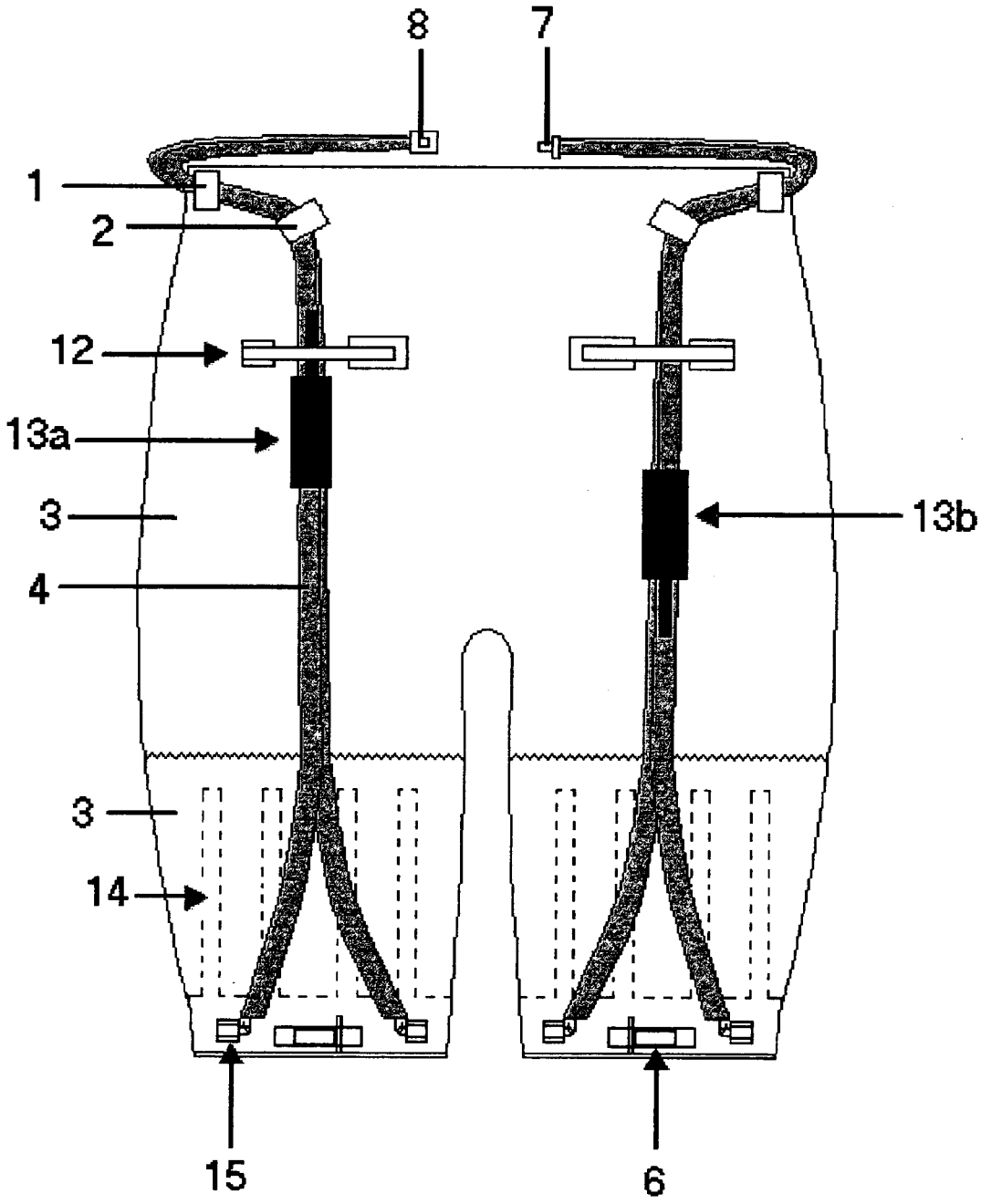
FIG. 6 is the alternative embodiments of FIG. 1 pertaining to FIG. 7, FIG. 8, FIG. 9, FIG. 10, FIG. 11, FIG. 12, and FIG. 13.
Figure 7:
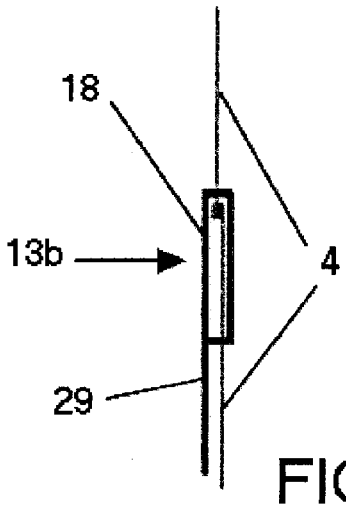
FIG. 7 is an alternative embodiment is a released position contracting the elastic strap.
Figure 8:
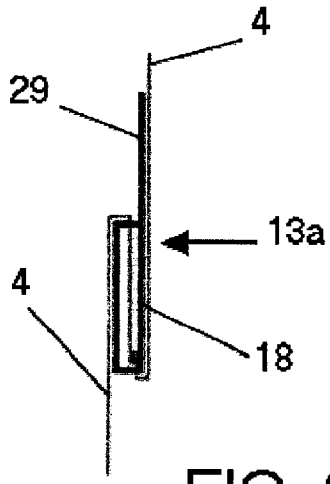
FIG. 8 is the same alternative embodiment of FIG. 7 presenting it in an engaged position elongating the elastic strap.
Figure 9:
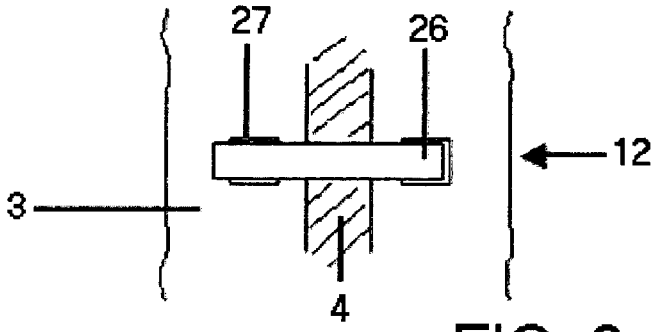
FIG. 9 is an alternative embodiment, which locks the engaged position of FIG. 8.

FIG. 6 is a drawing of the alternative embodiments that improve the fit and enhance the use associated with the invention. Elastic strap 4 will be engaged by an elastic harness handle 29 in FIG. 7 and FIG. 8. Elastic harness handle 29 is displayed in the elastic harness group 13*a* in FIG. 8 and 13*b* in FIG. 7. When elastic harness group 13*a* in FIG. 8 is in the engage position, elastic strap 4 will elongate to the exact preferred force by the runner or walker. When elastic harness group 13*b* in FIG. 7 is in the disengaged position elastic strap 4 will be contracted reducing the force. The engaging and disengaging allows an easier accessibility option compared to the buckle 11 in FIG. 5, which is located in the back. Elastic harness group 13*a*, 13*b* in FIG. 6 is not to replace the buckle 11 in FIG. 5, it only provides easier accessibility. Elastic harness group 13*a* and 13*b* will be locked using a lock strap group 12 in FIG. 9. Lock strap group 12 will be sewn to tight fitted running shorts 3 and will layover an elastic harness lever 29 in FIG. 5 then it will be attached to a lock pad material 27 in FIG. 9. Lock pad material 27 in FIG. 9 is also sewn to tight fitted running shorts 3.

Figure 10:
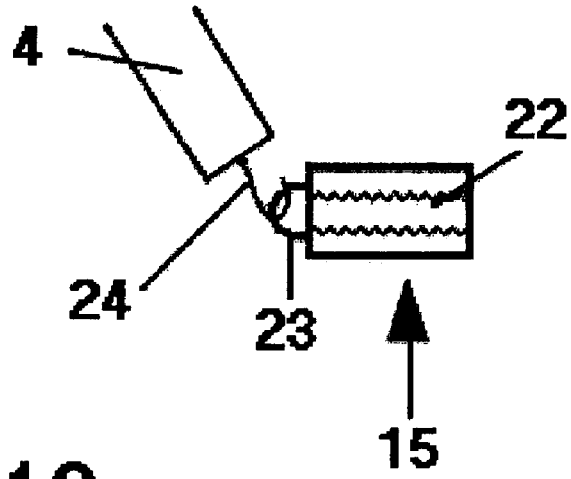
FIG. 10 is an alternative embodiment displaying a connection attached to the end of the elastic strap to the bottom of the Athletic Shorts.

An alternative to elastic strap 4 continuing around the back of the leg through the conduit is shown in FIG. 6. Elastic strap 4 hooks into an elastic hook fastener group 15. FIG. 10 illustrates elastic hook fastener group 15. An elastic hook fastener pad 22 is sewn to tight fitted running shorts 3. Elastic hook fastener pad 22 has an elastic hook fastener ring 23 connected at the end so that an elastic hook fastener 24 can connect to elastic hook fastener pad 22.

Figure 11:
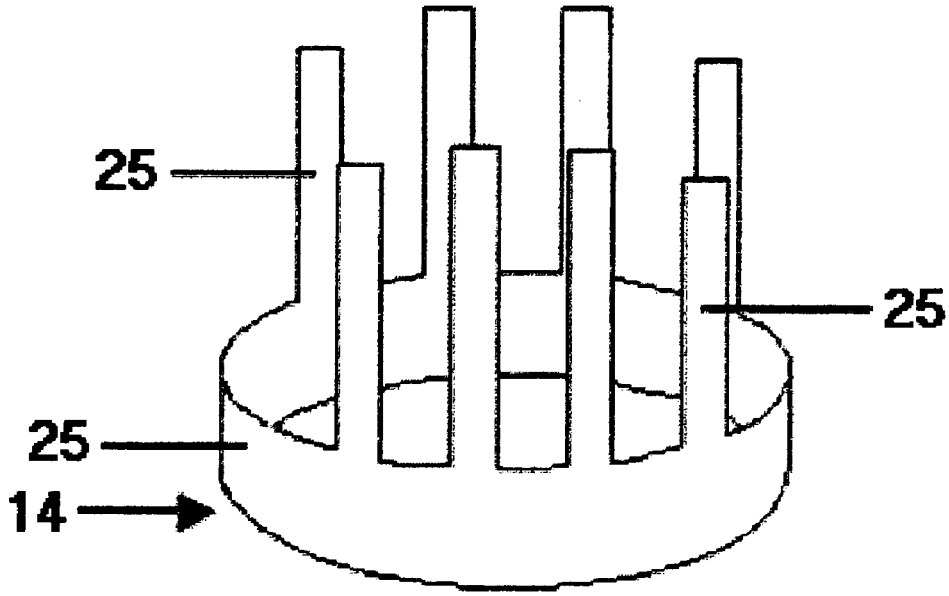
FIG. 11 is the alternative embodiment of a semi-flexible material inserted between two layers of the tight fitted running shorts.
Figure 12:
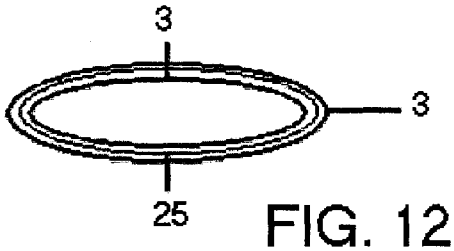
FIG. 12 is an alternative embodiment representing a cross sectional view at the bottom of the Athletic Shorts displaying the semi-flexible material discussed in FIG. 11.
Figure 15:
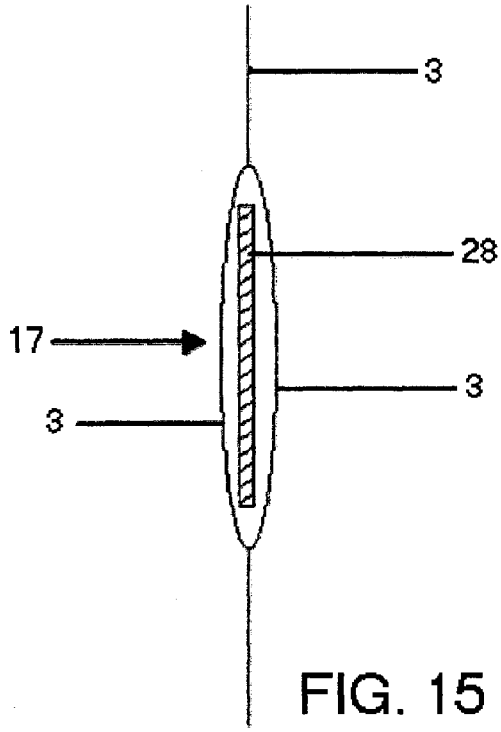
FIG. 15 is a cross section of an alternative embodiment to FIG. 14 of a semi-flexible material inserted between two layers of the tight fitted running shorts garment slightly below the waist.
Figure 13:
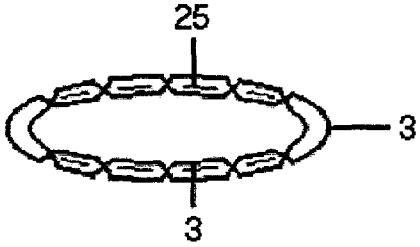
FIG. 13 is another cross sectional view of an alternative embodiment near the top of FIG. 11.
Figure 14:
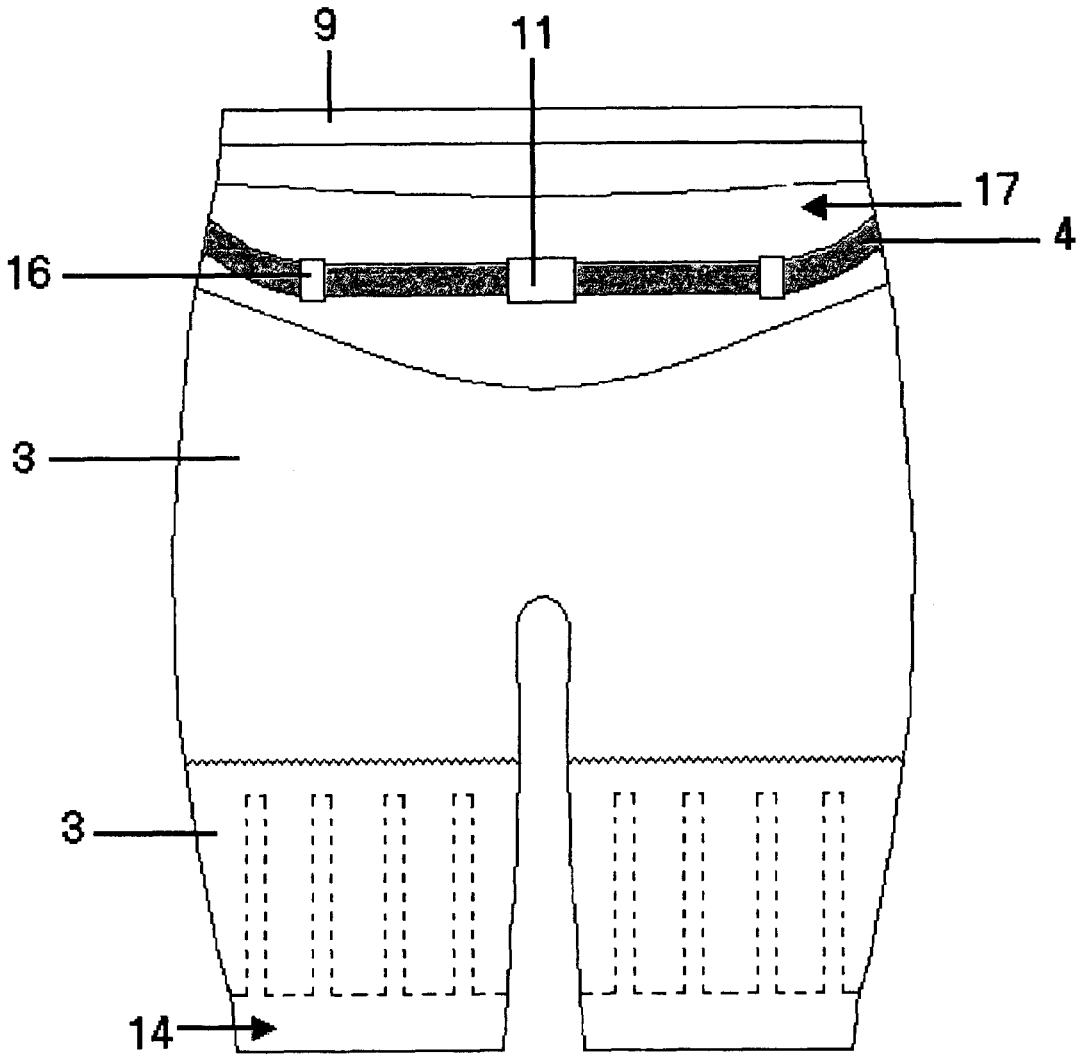
FIG. 14 is an alternative embodiment to FIG. 5 of the backside of the Athletic Shorts.

Another alternative near the bottom of FIG. 5 tight fitted running shorts 3 is a semi-flexible stabilizer group 14 displayed in FIG. 6. Semi-flexible stabilizer group 14 is illustrated in FIG. 11 and consists of a semi-flexible stabilizer material 25. Semi-flexible stabilizer material 25 is sewn between tight fitted running shorts 3 and the bottom portion is displayed in a cross sectional view FIG. 12. The upper portion of semi-flexible material 25 is displayed in FIG. 13. FIG. 13 displays a cross sectional view of the tight fitted running shorts 3 being sewn together holding semi-flexible material 25 in a fixed position. The purpose of semi-flexible stabilizer material 25 is to resist the upward force of elastic hook fastener group 15 in FIG. 6 when attached to tight fitted running shorts 3.

Figure 4:
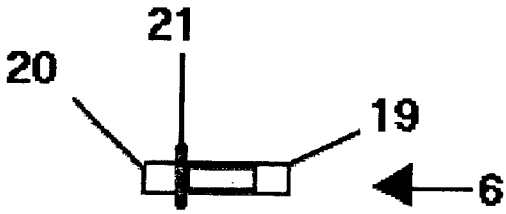
FIG. 4 is a tightening strap at the bottom part of the tight fitted running shorts.

The leg adjustment group 6 in FIG. 6 alternative works with the semi-flexible stabilizer group 14 by allowing the user to tighten the bottom of the tight fitted running shorts 3; which resists the force of the elastic hook fastener group 15 when attached. Leg adjustment group 6 is shown in FIG. 4. FIG. 4 consists of a leg adjustment strap 19 sewn on tight fitted running shorts 3. Leg adjustment strap 19 is then looped around a leg adjustment strap fastener 21. Leg adjustment strap fastener 21 is sewn on a leg adjustment pad 20, which is sewn on tight fitted running shorts 3 in FIG. 6. After looping around leg adjustment strap fastener 21 in FIG. 4 leg adjustment strap 19 re-attaches to itself with a hoop and loop fastener.

CONCLUSION, RAMIFICATIONS AND SCOPE

There are several advantages of this invention. Athletic Shorts as described herein will help a runner or walker to be able to walk or run farther and faster. This is accomplished by the elastic straps helping to raise the legs. These elastic straps become elongated when the runner or walker puts their foot down and give an upward pull when the runner or walker is raising their leg to take the next step. Athletic Shorts also help to keep the runner or walkers posture in a preferred hips tucked and head up position.

Athletic Shorts can take several alternative forms. The adjustment of the elastic straps using an elastic harness to help tighten and loosen the elastic straps is one alternative. The use of an elastic hook fastener as an alternative means of connecting the elastic to Athletic Shorts is another alternative. The use of a semi-flexible material sewn into Athletic Shorts to help keep the material from being forced up the leg by the elastic strap is another alternative. The semi-flexible material is also shown sewn into the back of Athletic Shorts to provide stability for the elastic to tuck in the hips. All of these alternatives are not dependent on each other. Therefore, one alternative or several alternatives could be combined to improve the users performance.

While the invention has been described along with the preferred and alternative embodiments, it will be understood that they are not intended to restrict the invention to these embodiments. On the contrary, the invention is intended to cover equivalents, alternatives, and modification that may be incorporated within the sum and substance of the invention as defined by the appended claims.

What is claimed is:

1. Athletic Shorts worn by runners or walkers comprising:

one continuous elastic strap starting at the middle of the back of the waist line, wrapping around the waist to the front of the waist, running down the center of the front of the legs, looping around the back of the legs, and returning back up the legs to the front waist line then to the middle of the back of the waist of a tight fitted running short, and belt loops and conduits sewn into the tight fitted running shorts at stress points or corners where the elastic strap has to make a turn for keeping the elastic straps in place, and a tightening and loosening means of holding the bottom of the legs of the tight fitted running shorts in place, consisting of a leg adjustment.

2. The improved Athletic Shorts of claim 1 comprising:

a tightening and loosening means for said elastic straps, consisting of an adjustable buckle, and a harness, and a connecting means for said elastic straps, consisting of an elastic hook fastener and an elastic hook fastener pad sewn into the tight fitted running shorts, and a means of enhancing the structure of the tight fitted running shorts to provide added support, consisting of a semi-flexible stabilizer material sewn into the tight fitted running shorts.

* * * * *